United States Patent [19]

Teeters

[11] 4,235,057

[45] Nov. 25, 1980

[54] BUILDING STRUCTURAL ELEMENT

[76] Inventor: Darrel L. Teeters, 12146 Fourth St., Yucaipa, Calif. 92399

[21] Appl. No.: 970,984

[22] Filed: Dec. 19, 1978

[51] Int. Cl.[3] ..... E04B 1/76; E04C 3/36

[52] U.S. Cl. ..... 52/404; 52/720; 52/793

[58] Field of Search ..... 428/166, 188; 52/720, 52/404, 573, 483, 793

[56] References Cited

U.S. PATENT DOCUMENTS

| | | | |
|---|---|---|---|
| 823,843 | 6/1906 | Buyten | 428/106 |
| 1,002,132 | 8/1911 | Brown | 428/166 |
| 1,356,764 | 10/1920 | Henderson | 428/188 X |
| 1,473,320 | 11/1923 | Ripper | 527/793 X |
| 2,578,599 | 12/1951 | Rose | 52/404 |
| 2,754,235 | 7/1956 | Wesner | 428/166 |
| 3,159,235 | 12/1964 | Young et al. | 52/404 |

FOREIGN PATENT DOCUMENTS

| | | | |
|---|---|---|---|
| 576801 | 6/1959 | Canada | 428/166 |
| 140351 | 8/1930 | Switzerland | 52/793 |
| 280592 | 11/1927 | United Kingdom | 52/573 |

*Primary Examiner*—Alfred C. Perham

*Attorney, Agent, or Firm*—Shoemaker and Mattare, Ltd.

[57] ABSTRACT

A building structural element having a plurality of air pockets defined therein. The air pockets are each essentially completely closed on all sides to completely trap air therein, and are all essentially completely isolated from each other to prevent air movement through and/or between pockets. One form of the invention includes a multi-layer panel unit and another form of the invention includes a stud.

3 Claims, 6 Drawing Figures

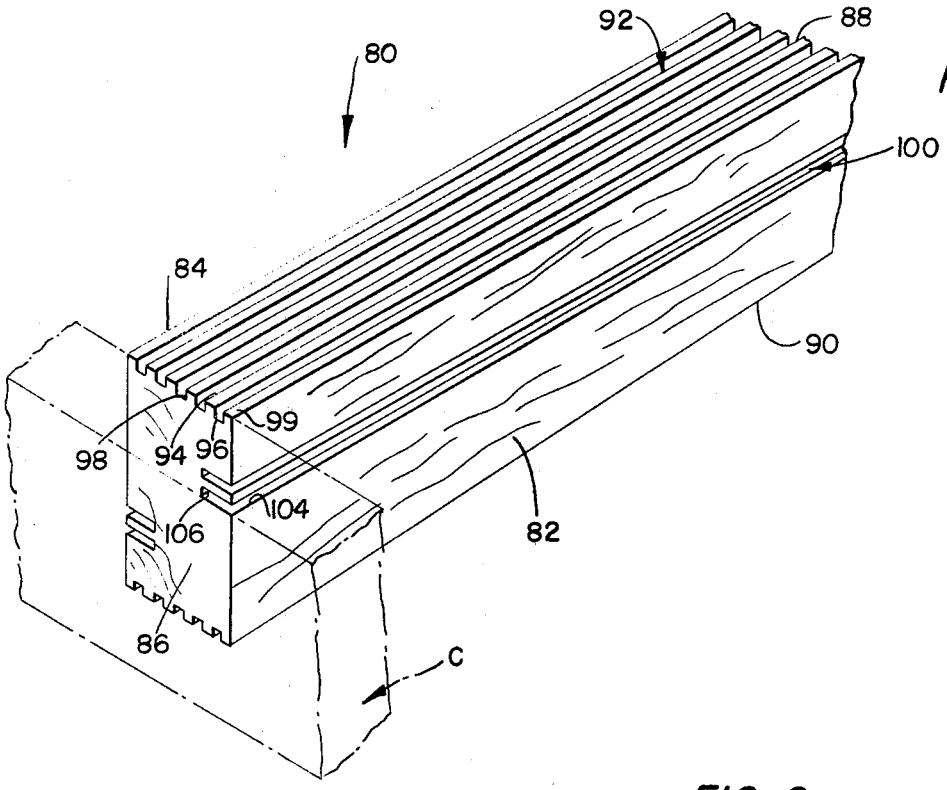
FIG. 5.
FIG. 6.
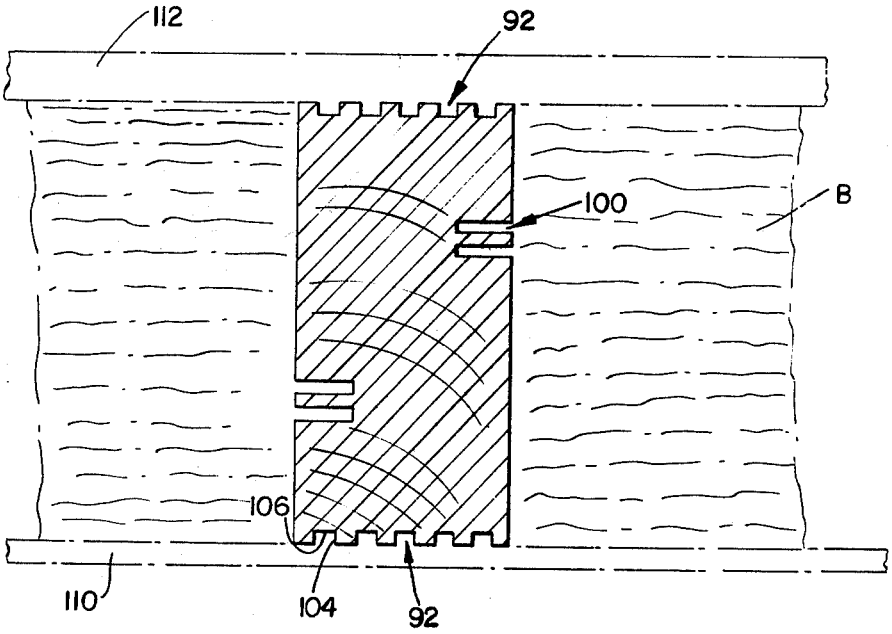

BUILDING STRUCTURAL ELEMENT

BACKGROUND OF THE INVENTION

The present invention relates in general to building elements, and, more particularly, to building elements with increased insulating features.

The building industry is expending much effort in the construction of "energy-efficient" units, so-called because features are included in the buildings which are intended to decrease energy transfer between the building and the environment. Such elements as thermal pane windows, extra insulation, seals, and the like have been used to more effectively insulate a building from the environment.

There has also been some effort directed to improving the thermal resistance of structural elements themselves. Such elements as indicated in U.S. Pat. Nos. 823,843 and 1,356,764 have been developed.

Heat transfer occurs via three modes, conduction, convection and radiation. By far, the most efficient mode, for purposes of building insulation, is convection. Thus, any element used in building construction should be designed to maintain this mode of heat transfer to the minimum amount possible.

The elements presently used in the building industry, such as those elements disclosed in the above-referenced patents, which are designed to have better insulating qualities than unmodified elements, have not effectively reduced convection. Thus, the air chambers disclosed in the above-referenced patents extend the full length and/or width of a panel. The air chambers thus do not confine air in all directions, and convection permits heat transfer among the air chambers and within the air chambers thereby vitiating, if not completely destroying, the insulating effect of those air chambers.

Other known devices include a portion of a grid pattern in one ply of a multi-ply material, and another portion of the grid in another ply of that material. The two grid portions generally are oriented perpendicularly with respect to each other. Such grid pattern suffers the above-discussed drawback with regard to insulating quality and reduction via convection, and also is difficult to bond together due to a reduction of surface area.

There is thus a need for a building element having insulating qualities which are improved over an unmodified element and which reduces convection heat transfer through that element.

SUMMARY OF THE INVENTION

The device embodying the teachings of the present invention is a building element having improved insulating qualities and which reduces, or essentially eliminates, convection heat transfer therethrough.

The building element includes a plurality of pockets which are isolated and completely separated from each other. The pockets trap air in all directions and thus improve the insulating characteristics of that element over an unmodified element.

The completely closed air pockets prevent air from moving either perpendicular to or parallel to the surfaces of the element, and thus reduces, or substantially eliminates, convection heat transfer within the element. Air is not permitted to flow out of any air pocket, and thus there is no air movement either through the element or between air pockets. Without air movement between pockets through the element, convection heat transfer is essentially eliminated.

The bonding together of the components of the device is also improved by the completely closed air pockets.

The invention is embodied in a multi-ply panel unit and a stud. The panel unit can be plywood, or the like, and includes an inner ply having a pattern of grooves, cuts, stamped depressions, or cross-pieces thereon to define pockets which form the dead air space or spaces of the present invention. Exterior layers are placed over the inner layer to sandwich same therebetween and to thus completely close the air pockets. The air pockets are completely isolated and separated from each other to prevent air movement between or through the pockets. A border is defined to close the peripheral air pockets.

The stud embodiment includes a plurality of grooves defined in the longitudinal faces of the stud. The grooves are closed when other building materials, such as insulation or the like, are placed next to the stud.

Laboratory tests performed on a three-ply plywood panel unit embodying the teachings of the present invention indicate a 20% increase in R-value over a solid plywood panel of the same thickness.

A metallic additive can also be used to further insulate the air pockets as by painting them, or the like.

The device of the present disclosure, and especially the panel unit, is attractive and can be used in many situations, such as, for example, subfloors, underlayments, plywood sidings, paneling, sheetings, or the like.

In some cases, such as plywood paneling and floor underlayment, the air pockets may be made in the outer ply or edge with the air spaces remaining open until installed over other materials.

In the case of plywood paneling, it is normally installed over another material such as wallboard or plywood.

Underlayment can also be applied over a subfloor, and in such cases, the air pockets would become sealed and effective when the panels are installed.

The outer edge concept would also be effective in panels made of only one ply, such as particle board.

OBJECTS OF THE INVENTION

It is a main object of the present invention to provide a building element having improved insulating qualities over a unmodified building element and which essentially prevents air movement through the element.

It is another object of the present invention to provide a building element having a plurality of completely closed, completely isolated and completely separated air pockets defined therein.

It is a further object of the present invention to provide a multi-ply panel building element having a plurality of completely closed, completely isolated and completely separated air pockets defined therein.

It is still another object of the present invention to provide a building element having a plurality of completely closeable, completely isolated and completely separated air pockets defined therein.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 5 is a perspective of a stud embodying the teachings of the present invention.

FIG. 6 is a plan view of the stud shown in FIG. 5 in an installed condition.

DETAILED DESCRIPTION OF THE PREFERRED EMBODIMENT

Figure 1:
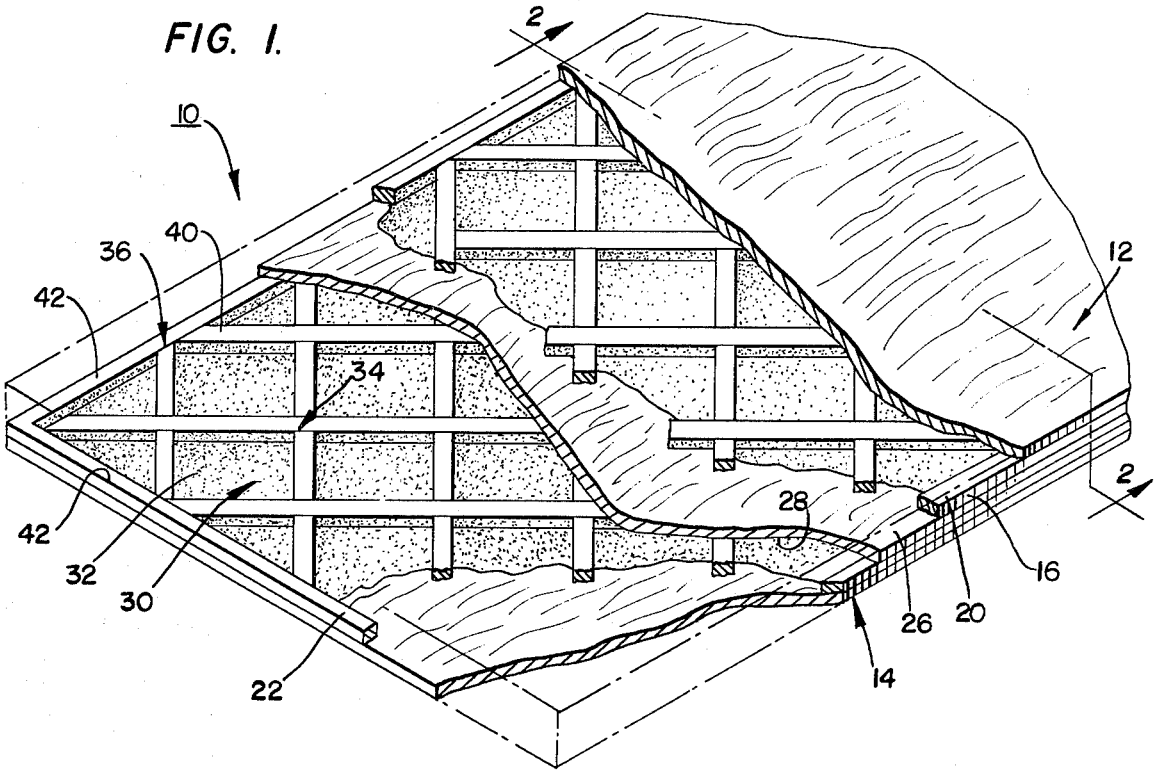
FIG. 1 is a partially cut away perspective of a multi-ply panel unit embodying the teachings of the present invention.

Shown in FIG. 1 is a wall element 10 embodying the teachings of the present invention. The element 10 is a mutli-ply panel unit and includes a pair of exterior layers 12 and 14 sandwiching an inner layer 16 therebetween. The various layers can be in the form of laminations or the like, if so desired, and can be any planar material, however, plywood is preferred. Edge pieces such as longitudinal edge pieces 20 and end edge pieces 22 define a border around the peripheral edge of the panel unit and are located on both the top surface 26 and the bottom surface 28 of the inner layer 16 as shown in FIG. 1. Of course, the terms top, bottom, inner and outer with regard to the FIGS. 1 and 2 embodiment are terms of convenience and are not intended to be limiting.

A grid 30 is defined on both top and bottom surfaces of the inner panel layer. A plurality of grid defining cross-pieces are attached to the inner panel layer surfaces 26 and 28. As shown in FIG. 1, the cross-pieces are diagonally disposed on the inner panel unit to define a plurality of pockets 32. The cross-pieces can be cut to be interjoined with each other at intersections, such as intersection 34, or cut to abut each other at such intersections. Viewed along the longitudinal centerline of the panel unit, the pockets are diamond-shaped. As shown in FIG. 1, the cross-pieces intersect the edge pieces at intersections, such as intersection 36.

As can be seen in FIG. 1, the pockets are each defined by the cross-pieces which form the sidewalls of the pocket, and the inner layer surface which forms the bottom of the pocket. It is a very important feature of the present embodiment of this invention that the pockets are isolated from each other. The pockets are isolated from each other by the cross-pieces and the inner panel. The pockets are thus separate, discrete elements. It is the isolation of the pockets from each other which provide special advantages to the unit embodying the teachings of the present invention. No convection currents are permitted to travel through the panel. Such convection currents would permit heat transfer from one pocket to the next, thereby vitiating the insulating effects of the pockets. The air in each of the pockets 32 is thus trapped in all directions which are parallel to the faces of the panel, and cannot move in any manner which would allow heat interchange between pockets via convection.

The exterior panels 12 and 14 are placed on top of the grid structure to be attached to, or at least rest on, upper surfaces 40 of the cross-pieces and upper surfaces 42 of the edge pieces.

Figure 2:
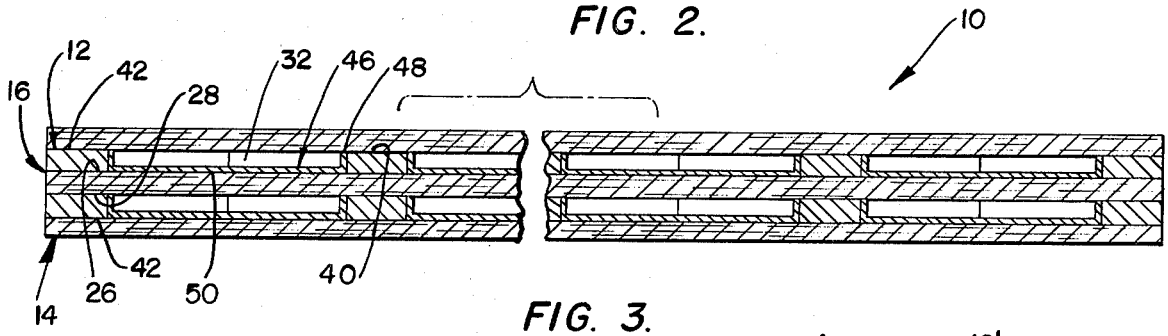
FIG. 2 is a view taken along line 2—2 of FIG. 1.

As can be seen in FIGS. 1 and 2, the exterior panels thus close the top of the pockets thereby closing the pockets against air movement perpendicular to the panel faces. All of the pockets 32 are thus completely closed on all sides thereof by the grid cross-pieces and by the panel faces. The completely closed pockets essentially prevent heat transfer by convection in either a direction perpendicular to or a direction parallel to the panel unit faces.

A liner 46, such as aluminum foil, or other such metal, or metallic paint, or the like, can be placed on the inner surfaces of the pockets to further enhance the insulating qualities of the isolated air pockets. Thus, as shown in FIG. 2, insulation can be located on pocket sides 48 and the pocket bottom 50.

Figure 3:
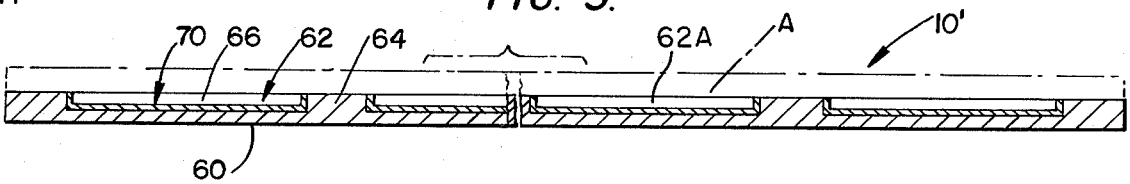
FIGS. 3 and 4 are modifications of the FIG. 1 panel unit.
Figure 4:
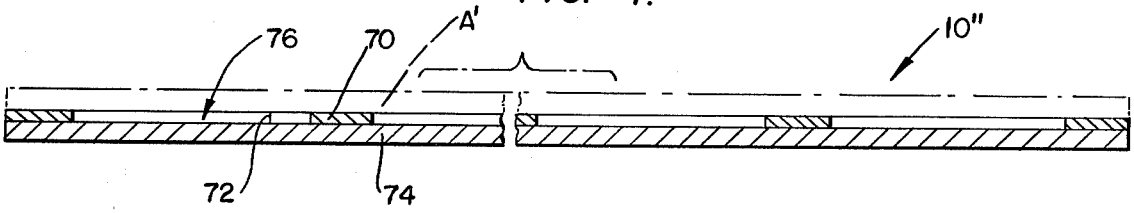

Two other forms of the panel unit are shown in FIGS. 3 and 4 as units 10' and 10'', respectively. Unit 10' is integral and includes a base layer 60 and a plurality of pockets 62 defined in that base layer by indentations thereinto. Each of the pockets 62 is separated and isolated from adjacent pockets by partitions 64 which define a groove 66 which is similar to groove 30. The grid 66 includes pockets which are diamond-shaped with respect to a longitudinal centerline of the panel unit, and, of course, are isolated from each other. Edge pieces define a border for unit 10' and are similar to edge pieces 20 and 22 of unit 10. The pockets 62 may also be lined with insulation layers 70 situated on the sides and bottom of the pockets. The pockets 62 are defined in an outer surface of the panel unit 10' and are closed when the unit 10' is installed over other material such as shown in FIG. 3 where element A is indicated over the pockets 62A. For example, thin plywood paneling is usually installed over a gypsum wallboard or other subwall material, and wood underlayments are usually installed over subfloors, and when installed, the panels would become effective.

The panel unit 10' is preferably thin plywood such as plywood paneling or particle board underlayment or other simulated wood panels which are either too thin for inner ply air pockets or are made of only one ply.

It is also noted that it is possible that the outer surface structure can also be achieved by glueing a grid to the outer surface of panels and the grid, in some cases, need not be wood. Plywood paneling, for example, could have an outer surface grid made of paper or cardboard because such paneling is not normally designed to contribute toward the structural stability of a wall or building. Such alternative structure is shown in FIG. 4 wherein a plurality of cross-pieces 70 are mounted, as by glueing, or the like, on outer surface 72 of a base 74 to define separate, isolated pockets 76. The pockets are also closed when another element, such as element A', is placed over the pockets. Edge pieces are also included in the unit 10'', and the pockets 76 are also diamond-shaped as in the units 10 and 10' discussed above. The pockets 76 are similar in structure, function and operation to the pockets 32 and 62 of the units 10 and 10', respectively, which are similar in structure, function and operation to each other.

It is here noted that the term "outer surface" refers to that side of a panel which is bonded or otherwise attached to a subsurface material.

Yet another form of the present invention is shown in FIGS. 5 and 6, and includes a stud 80. The stud 80 includes a pair of side faces 82 and 84, a pair of end faces, such as face 86, and a pair of edge faces 88 and 90. As shown in FIG. 5, each of the edge faces 88 and 90 has a plurality of grooves, such as groove 92, defined therein to extend longitudinally of the stud. The grooves 92 include side walls 94 and a bottom 96 and extend for essentially the entire length of the stud. Partitions 98 separate each groove from adjacent grooves, and partitions 99 are located on the outermost portion of the edge to have one wall thereof flush with the face of edge 82 and 84. The outer partitions close the adjacent grooves 92 and are similar to the edge-pieces 20 and 22 of the FIG. 1 embodiment.

As also shown in FIG. 5, each of the side faces 82 and 84 has a plurality of grooves, such as grooves 100, defined therein to extend longitudinally of the stud.

Each of the grooves 100 includes side walls 104 and a bottom 106 and extends for essentially the entire length of the stud. The side walls separate adjacent grooves and essentially completely prevent air movement between adjacent grooves. As best shown in FIG. 6, the grooves in the two side faces are in groups with the group of grooves on one side face being offset from the group of grooves in the other side face in a preferred embodiment.

The grooves 100 define air pockets when insulating materials are installed about the stud. Such insulating material is indicated in FIG. 6 by the reference numeral B. The grooves 92 also form air pockets which are closed by other wall elements when the walls are erected, as shown in FIG. 6 wherein interior wall covering 110 and exterior wall covering 112 about stud 80 close the air pockets defined by the grooves 92. It is noted that other materials will contact the ends 86 of the stud to thereby close the grooves 92 and 100 to form the isolated, separated air pockets forming the subject of the instant disclosure. Such other materials are represented in FIG. 5 by element C. The studs 80 are thus treated on all four longitudinal sides and the air pockets thus defined are closed and become effective when wall covering materials and wall insulating materials are installed over and around the studs. These air pockets also can have insulation located therein such as the metallic liner or metallic paint described above with regard to the units 10, 10' and 10''. As shown in FIG. 6, grooves 92 can be closed by other building panels, such as interior panels 100 and exterior panels 112, if so desired.

Thus, in all forms of the present invention, the total grid pattern is within each insulating ply, and convection heat transfer is effectively prevented by the isolation, separation and closing of the air pockets.

In the preferred embodiments of units 10, 10' and 10'', the air pockets are approximately two inches long and two inches or less wide. It is also noted that the exterior panels being bonded to the grid in units 10, 10' and 10'' add further strength to these units and improves the shear or racking values over those of the prior art.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A building structural element comprising:

a stud having a pair of longitudinal sides, a pair of longitudinal edges and a pair of end edges;

a plurality of edge grooves defined in said edges to extend essentially the entire length of said stud, said edge grooves having partitions completely separating a groove from adjacent grooves to prevent air movement between edge grooves, said grooves on one edge being aligned with edge grooves on the other edge of said stud;

a plurality of side grooves defined in said sides to extend essentially the entire length of said stud, said side grooves having partitions separating a groove from adjacent grooves to prevent air movement between said grooves, said side grooves being located in groups with groups of side grooves on one side face being offset with respect to groups of side grooves on the other side face; and closing means closing said grooves to trap air in said grooves on all sides of each groove, said means including insulation covering said side grooves and wall covering over said edge grooves.

2. The building structural element defined in claim 1 wherein said grooves are essentially rectangular in transverse cross-section.

3. The building structural element defined in claim 2 wherein said side grooves extend deeper into said stud than do said edge grooves.

* * * * *